United States Patent [19]

Kennedy et al.

[11] Patent Number: 4,759,299

[45] Date of Patent: Jul. 26, 1988

[54] DESLAGGER FOR INSTRUMENT EQUIPPED BOILER PORT

[76] Inventors: Jesse R. Kennedy, 5217 S. Marietta Dr.; Marcus R. Kennedy, Rte. 3, Box 94, both of Mobile, Ala. 36618

[21] Appl. No.: 113,000

[22] Filed: Oct. 27, 1987

[51] Int. Cl.[4] ..... F23N 5/24

[52] U.S. Cl. ..... 110/193; 110/182.5; 266/100; 431/123

[58] Field of Search ..... 110/182.5, 193; 266/269, 99, 100; 431/122, 123

[56] References Cited

U.S. PATENT DOCUMENTS 4,619,533 10/1986 Lucas et al. ..... 266/269 X 4,653,409 3/1987 Eriksson ..... 110/182.5

*Primary Examiner*—Edward G. Favors

*Attorney, Agent, or Firm*—Richard C. Witman

[57] ABSTRACT

An instrument assembly is mounted to view the inside of a furnace or boiler, its probe extending into a port in the furnace wall. To remove slag built up within the port, a deslagger unit is mounted upon the assembly and includes a shiftable blade surrounding the probe lens. A displacing mechanism mounted upon the assembly is periodically actuated to rectilinearly shift the blade within the confines of the port to dislodge built up slag therein.

11 Claims, 2 Drawing Sheets

DESLAGGER FOR INSTRUMENT EQUIPPED BOILER PORT

FIELD OF THE INVENTION

This invention relates generally to an improved apparatus for imaging or measuring the conditions in the interior of chemical recovery boilers, kilns, power boilers, and the like and more specifically, to a device for deslagging the port through which an instrument views such interior.

BACKGROUND OF THE INVENTION

Most pulp and paper mills conventionally are provided with chemical recovery boilers. The chemical recovery boiler is basically a steam generating power boiler wherein a molten bed of solids, including black liquor, a by-product of the wood digesting process, is present at the bottom of the boiler. The need arises for the operator to be aware of various conditions within the boiler such as configuration and height of the smelt bed, for both economic and safety reasons.

Typically, various instruments are mounted through a port in the boiler wall to monitor and control the system operation. Viewing means such as a camera, or pyrometer, for supplying a remote image or record, is mounted exteriorly of the boiler and includes a lens or probe extending into a port in the boiler wall. The black liquor in the boiler interior frequently slags over the interior of the port, obscuring the field of view or signal of the instrument lens or probe which often damages the sensing equipment or at least compromises the signal therefrom. The need arises for means to efficiently and reliably remove slag from the boiler port and for any instrument therein.

SUMMARY OF THE INVENTION

Accordingly, it is an object of the present invention to provide an improved apparatus for deslagging the port through which an instrument views or senses the interior condition of a boiler or furnace.

It is another object of the present invention to provide a port deslagger device which is mountable on a reading instrument itself and/or its support structure.

It is a further object of the present invention to provide an improved port deslagger, the operational part of which is so configured as to avoid the adjacent viewing or sensing structure of an instrument and associated support structure in its path.

Still another object of the present invention is to provide an improved port deslagger which, during its operation, will also remove excess slag from an adjacent camera lens or other probe element itself.

The present invention utilizes an instrument support structure including a tubular member extending toward and parallel to the axis of a port provided in a boiler wall. A camera lens or other sensing probe member extending from the tubular member into the port is surrounded by a deslagging blade so configured as to avoid the optical view of the lens or sensing area of the probe, as well as the tubular member during rectilinear movement of the blade. This blade is mounted upon the forward end of a support member which is freely slidable over the tubular member. By manipulation of the support member, the blade is rectilinearly displaced to deslag both the periphery of the camera lens or probe element and the boiler port.

DESCRIPTION OF THE PREFERRED EMBODIMENT

Figure 1:
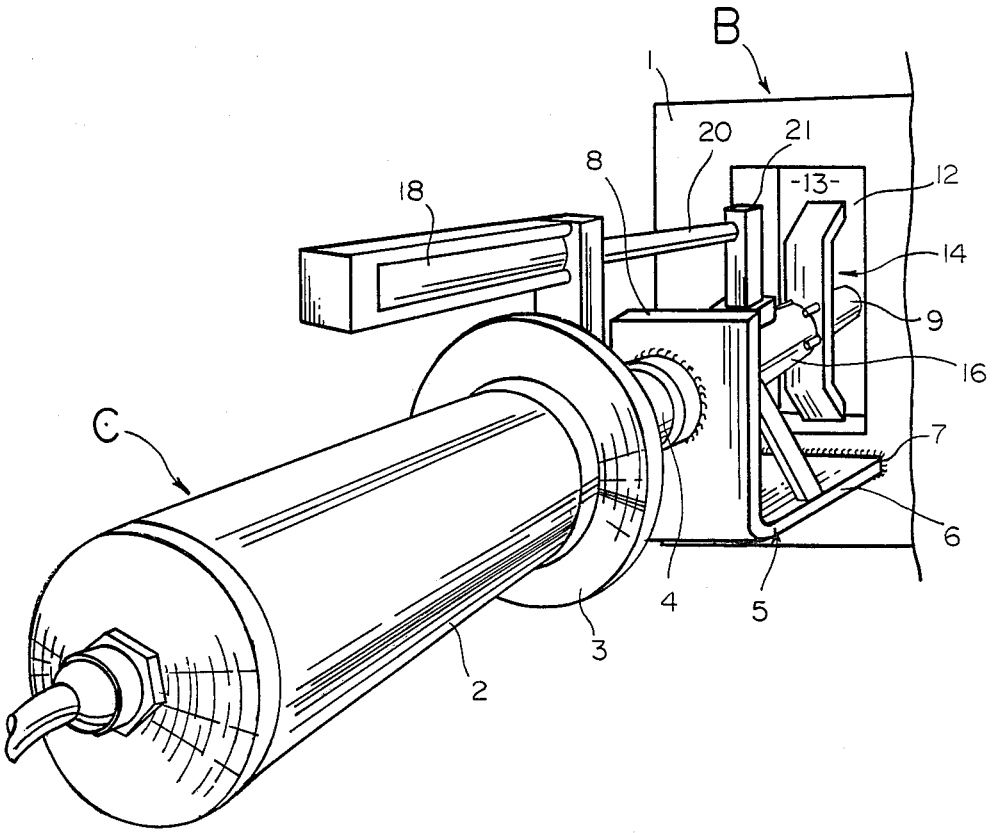
Figure 2:
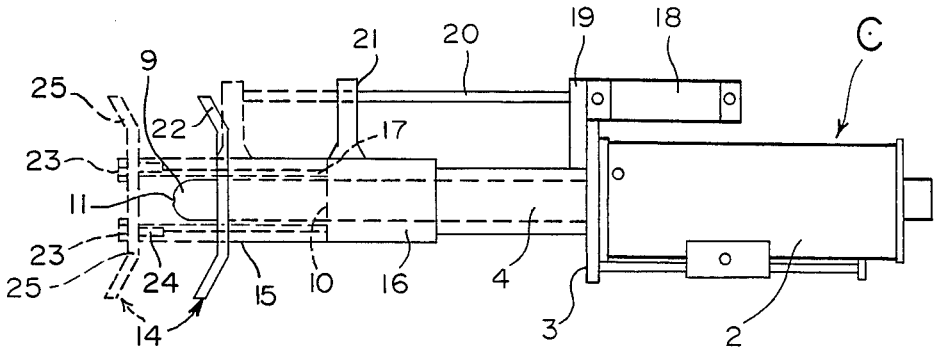

The present invention will be better understood from the following detailed description of a preferred embodiment. This description makes reference to the accompanying drawings, in which:

FIG. 1 is a perspective view of the measuring instrument and port deslagger mounted on a boiler wall; and FIG. 2 is a side view of the instrument and deslagger with the supporting bracket removed for clarity and illustrating the rectilinear movement of the deslagging blade.

Similar reference characters designate corresponding parts throughout the several figures of the drawing.

Referring now to the drawing, particularly FIG. 1, the present invention will be understood to relate to an improvement associated with a measuring instrument, generally designated C, which is mounted adjacent the external wall 1 of a furnace or boiler B. Throughout the description of the invention, the term "instrument" will be understood to encompass any measuring or recording apparatus such as a video camera or pyrometer and the term "probe" will apply to any sensing, detecting, or viewing member serving to read or gather an image, data, or condition. The instrument C thus may comprise a camera pyrometer or other apparatus. In the case of a camera, it may be as disclosed in out U.S. Pat. No. 4,695,881, issued on Sept. 22, 1987. This instrument includes a housing 2 from which extends a fixed, elongated wallbox 4 having a rearmost flange 3. The foregoing unitary structure is adapted to be rigidly affixed adjacent the boiler wall 1 by appropriate means such as the illustrated mounting bracket 5. Of course suitable means (not shown) may be provided to allow selective axial adjustment of the instrument relative the boiler. The bracket 5 may include a lower or first member 6 attached at one end 7 to the exterior of the boiler wall 1, while a vertical or second member 8 surrounds and supports the wallbox 4 of the assembly C. Quite obviously alternate mounting means can be employed.

As shown most clearly in FIG. 2 of the drawing, an elongated sensing member 9 such as a shroud or probe axially projects from the forward end 10 of the wallbox 4 and, in the case of a camera instrument, terminates in a lens aperture 11. Even with other instruments, such as a pyrometer, an endmost aperture may be provided to expose the actual sensing area of a detector device contained within the shroud 9. The periphery of the lens shroud 9 is preferably circular in cross-section and of a diameter substantially less than that of the circular wallbox 4.

As described in our earlier above referenced patent, the apparatus C is used by mounting it so that the probe member 9 is disposed within the space defined by a port 12 provided within the boiler wall 1. It will be appreciated that furnaces or boilers benefiting from this invention may be provided with several types of openings such as air ports, observation doors and viewing ports, any of which are subject to slag build up. Conditions within the operating interior 13 of the boiler are monitored by maintaining the probe 9 properly positioned within the selected port 12. The efficiency and reliability of images or readings as recorded by the instrument 2 obviously will be affected by any foreign material such as slag, which builds up or becomes lodged within the confines of the port 12 and/or accumulates upon the forward portion of the shroud 9, particularly in the area of the aperture 11 and its field of view or sensitivity.

Prior to development of the current invention, boiler operators have had to periodically manually remove the slag from the port. This chore, accomplished every 30 minutes to an hour, required the use of a long rod to knock out slag build-up within the port and occasionally resulted in striking of and damage to the sensing or viewing member 9.

By the present invention, an improved arrangement is provided wherein a deslagger member, in the form of a substantially vertically disposed blade 14, is mounted for rectilinear displacement within the confines of the boiler port 12. FIG. 2 most clearly illustrates the blade 14 attached to the forward portion 15 of support means comprising a tubular or elongated deslagger housing 16 carried by the similarly configured wallbox 4. To insure the smooth axial displacement of the housing 16 over the periphery of the wallbox 4, a bushing or bearing sleeve 17 is provided within the interior of the housing 16. This sleeve is constructed of any suitable material exhibiting a low coefficient of friction relative the engaged external periphery of the wallbox 4 and capable of withstanding the elevated temperature of the environment, such as, high temperature TEFLON or a suitable ceramic material.

The housing 16, with its attached blade 14 is selectively displaced between the alternate positions depicted in FIG. 2 by suitable actuator means 18 such as a pneumatic or hydraulic cylinder secured relative the wallbox flange 3 by a bracket 19. An actuating rod 20 extending forwardly from the actuator 18 is affixed to an arm 21 in turn attached to the deslagger housing 16 whereby axial displacement of the rod 20 is translated into a corresponding movement of the deslagger blade 14 between the alternate portions of FIG. 2.

The illustrated blade 14 will be seen to include a central, vertically disposed section 22 provided with an aperture closely surrounding the shroud 9. This central section 22 is suitably attached to the forward portion 15 of the housing 16 such as by fasteners 23 passing therethrough and into appropriate fixtures on the housing such as weld nuts 24. In this manner, a blade 14 may be readily replaced should it become worn after extended use. The top and bottom end sections 25 of the blade are preferably angled forwardly to improve the deslagging effectiveness during rectilinear movement of the blade into and out of the boiler port 12. Alternatively, the blade may comprise a flat member disposed in a single vertical plane. In any case it will be understood that the peripheral configuration of the blade 14 is selected according to the shape of the port 12. A rectangular blade is shown in the drawing, corresponding to the similar shape of the port 12. However, many such ports are oval shaped, in which case the blade will likewise be oval shaped.

In the operation of the invention, it will be understood that the aperture or forward tip 11 of the shroud 9 is normally disposed within the confines of the boiler port 12 and the deslagger blade 14 is in a retracted position, substantially rearwardly of the shroud tip 11. Periodically, or as dictated by a slag build up within the port, the actuator 18 is manipulated to extend its rod 20 whereupon the housing 16 and blade 14 are advanced to an axial point placing the blade 14 forwardly of the shroud tip 11 and substantially through the thickness of the boiler port. The foregoing actuation of the deslagger is most conveniently accomplished by means of any well known adjustable timing mechanism with, of course, provision for a manual override.

It is to be understood that the present invention is not limited to the sole embodiment described above, but encompasses any and all embodiments within the scope of the following claims.

What is claimed is:

1. An instrument assembly mounted adjacent a port in the wall of a furnace, said assembly including a recording device having a wallbox extending toward said furnace wall, a probe member extending from said wallbox and through the furnace wall port, the improvement comprising;

deslagger means mounted upon said instrument assembly and including a support member engaging said wallbox, a blade element attached to said support member, displacement means mounted upon said assembly operable to displace said support member and blade element in a rectilinear manner within said port to remove slag built up within said port adjacent said probe member.

2. The apparatus of claim 1 wherein, said support member includes a housing surrounding said wallbox.

3. The apparatus of claim 1 wherein, said support member includes a forward portion having said blade element attached thereto.

4. The apparatus of claim 1 wherein, said displacement means includes a fluid actuated cylinder having rod means joined to said support member.

5. The apparatus of claim 1 wherein, said blade element includes a substantially vertically disposed member having an aperture surrounding said probe member.

6. The apparatus of claim 2 including, a sleeve-like bearing mounted within said housing.

7. The apparatus of claim 5 wherein, said aperture is circular.

8. The apparatus of claim 5 wherein, said blade element is displaceable to a forwardmost position substantially beyond said probe member.

9. The apparatus of claim 5 including, forwardly angled end sections on said blade vertically disposed member.

10. The apparatus of claim 5 wherein, said blade element includes a central section having said aperture therethrough, and opposite end sections projecting from said central section at a forwardly inclined angle.

11. The apparatus of claim 6 wherein, said bearing includes a sleeve of TEFLON material.

* * * * *